US007377801B2

(12) United States Patent
Sakaguchi

(10) Patent No.: US 7,377,801 B2
(45) Date of Patent: May 27, 2008

(54) SHIELDED CABLE CONNECTING STRUCTURE

(75) Inventor: Tadahisa Sakaguchi, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/653,368

(22) Filed: Jan. 16, 2007

(65) Prior Publication Data

US 2007/0178743 A1 Aug. 2, 2007

(30) Foreign Application Priority Data

Feb. 1, 2006 (JP) ..... 2006-024734

(51) Int. Cl.
*H01R 4/24* (2006.01)

(52) U.S. Cl. ..... 439/394; 439/408

(58) Field of Classification Search ..... 174/84 C; 439/394, 395, 399, 402, 408
See application file for complete search history.

(56) References Cited

U.S. PATENT DOCUMENTS 3,539,707 A * 11/1970 Kindell et al. ..... 174/84 C
3,767,841 A * 10/1973 Anderson et al. ..... 174/84 C
3,924,057 A * 12/1975 Sosinski ..... 174/94 R
4,472,596 A * 9/1984 Brown et al. ..... 174/84 C
4,973,258 A * 11/1990 Fusselman ..... 439/98
5,484,305 A * 1/1996 Diniz et al. ..... 439/421
5,820,402 A * 10/1998 Chiacchio et al. ..... 439/398
6,083,034 A * 7/2000 Kameyama ..... 439/394
6,155,847 A * 12/2000 Wright ..... 439/98
6,165,003 A * 12/2000 Bigotto ..... 439/406
6,443,738 B2 * 9/2002 Yamanashi et al. ..... 439/45
6,503,095 B1 * 1/2003 Endo et al. ..... 439/397

FOREIGN PATENT DOCUMENTS

JP 08-340615 A 12/1996

* cited by examiner

*Primary Examiner*—Thanh-Tam Le
(74) *Attorney, Agent, or Firm*—Sughrue Mion, PLLC

(57) ABSTRACT

A shielded cable connecting structure for connecting a shielded cable to an electric wire having a conductor, the shielded cable including an electric wire portion which has a conductor and an inner sheath covering the conductor, a braided wire braided around the inner sheath, and an outer sheath covering the braided wire, the shielded cable connecting structure includes a connecting member. The connecting member includes a connecting main body, a first press-clamping portion which holds the shielded cable, a second press-clamping portion which holds the electric wire, a first press-contacting portion which is electrically connected to the braided wire of the shielded cable in a state that the shielded cable is pressed to be inserted into the first press-contacting portion, and a second press-contacting portion which is electrically connected to the conductor of the electric wire in a state that the electric wire is pressed to be inserted into the second press-contacting portion in the same direction as a direction of insertion of the shielded cable into the first press-contacting portion. The braided wire of the shielded cable is connected to the electric wire through the first press-contacting portion and the second press-contacting portion.

12 Claims, 8 Drawing Sheets

(PRIOR ART)

SHIELDED CABLE CONNECTING STRUCTURE

BACKGROUND OF THE INVENTION

This invention relates to a shielded cable connecting structure used for grounding a braided wire incorporated in a shielded cable.

There is known a related shielded cable connecting structure in which insulating sheaths of shielded cables are removed to thereby expose respective braided wires, and these braided wires are twisted, and then are press-fastened by barrels (see, for example, JP-A-8-340615 (FIG. 1)).

In the shielded cable connecting structure disclosed in JP-A-8-340615, the insulating sheaths of the shielded cables 101 are removed to thereby expose the braided wires 102, and these braided wires 102 are gathered together, and then the shielded cables are press-fastened together by barrels 103, and the braided wires are press-fastened to a drain wire 104 by barrels 105, as shown in FIG. 8.

However, in the related shielded cable connecting structure disclosed in JP-A-8-340615, the operation for gathering the exposed braided wires 102 together (that is, a so-called twisting operation) is difficult, and therefore the braided wires 102 (each composed of woven fine wires) become loose, depending on the degree of skill, so that the number of the fine wires decreases, or the capacity decreases. Thus, the efficiency of the operation is not good, and it is difficult to enhance the productivity by achieving the automated production.

Generally, in order that a disturbance developing around a conductor will not intrude into the conductor when flowing a very small voltage signal or a very small current signal through the conductor, a grounded braided wire is provided around the conductor to cover the same so as to capture the disturbance, and the thus captured disturbance is positively flowed to a grounding circuit. Therefore, the capacity of the braided wire is determined in a condition in which the braided wire covers the conductor over the entire periphery thereof. Considering this with respect to the structure of JP-A-8-340615, the areas of non-shielded portions (where the conductor is not covered with the braided wire over the entire periphery thereof) increase as a result of gathering the braided wires together, so that there is a fear that the reliability against the disturbance is not satisfactory.

SUMMARY OF THE INVENTION

This invention has been made in view of the above circumstances, and an object of the invention is to provide a shielded cable connecting structure in which a grounding path of a braided wire can be positively secured, and besides a good operation efficiency can be achieved.

1) According to the present invention, there is provided a shielded cable connecting structure for connecting a shielded cable to an electric wire having a conductor, the shielded cable including an electric wire portion which has a conductor and an inner sheath covering the conductor, a braided wire braided around the inner sheath, and an outer sheath covering the braided wire, the shielded cable connecting structure comprising:

a connecting member that includes:

a connecting main body;

a first press-clamping portion which holds the shielded cable;

a second press-clamping portion which holds the electric wire;

a first press-contacting portion which is electrically connected to the braided wire of the shielded cable in a state that the shielded cable is pressed to be inserted into the first press-contacting portion; and a second press-contacting portion which is electrically connected to the conductor of the electric wire in a state that the electric wire is pressed to be inserted into the second press-contacting portion in the same direction as a direction of insertion of the shielded cable into the first press-contacting portion, wherein the braided wire of the shielded cable is connected to the electric wire through the first press-contacting portion and the second press-contacting portion.

In the invention of the above Paragraph 1), the shielded cable is pressed to be inserted into the first press-contacting portion, thereby electrically connecting the braided wire of the shielded cable to the first press-contacting portion, and the electric wire is pressed to be inserted into the second press-contacting portion in the same direction as the direction of insertion of the shielded cable, thereby electrically connecting the conductor of the electric wire to the second press-contacting portion. As a result, the braided wire, while kept braided around the inner sheath, is connected to the electric wire through the first press-contacting portion and the second press-contacting portion without being gathered or twisted, and therefore the braided wire is grounded while maintaining a sufficient capacity. And besides, the connection is made in such a manner that the one wire is not exposed, but is kept covered with the braided wire, and therefore the one wire will not be subjected to a disturbance. Furthermore, the shielded cable and the electric wire can be connected to the connecting member merely by inserting them into the connecting member in the same direction, and therefore the efficiency of the operation can be markedly enhanced. Therefore, the connecting path of the braided wire can be positively secured, and besides the good operation efficiency can be achieved.

2) The shielded cable connecting structure of the above Paragraph 1) is further characterized in that the connecting member includes an insertion guide portion having a generally slanting shape provided at at least one of the first press-contacting portion and the second press-contacting portion.

In the invention of the above Paragraph 2), the shielded cable or the other wire can be inserted into the first press-contacting portion or the second press-contacting portion via the insertion guide portion, and therefore the smooth and positive insertion can be effected, and this prevents the incomplete insertion, thus eliminating an error in the operation.

3) The shielded cable connecting structure of the above Paragraph 1) or Paragraph 2) is further characterized in that the connecting member has a notch for preventing mutual deformation of the first and second press-contacting portions, the notch being provided between the first and second press-contacting portions.

In the invention of the above Paragraph 3), during the time when the shielded cable is press-contacted with the first press-contacting portion after the other wire is press-contacted with the second press-contacting portion, stresses, developing when inserting the shielded cable, will not be transmitted to the second press-contacting portion thanks to the provision of the notch. Therefore, the first press-contacting portion and the braided wire of the shielded cable, as well as the second press-contacting portion and the conductor of the other wire, can be kept in the positively connected condition without inviting a relative displacement therebetween, etc.

4) The shielded cable connecting structure of any one of the above Paragraphs 1) to 3) is further characterized in that the first press-clamping portion and the second press-clamping portion are formed by a single press-clamping portion (common press-clamping portion).

In the invention of the above Paragraph 4), the press-clamping portion for holding the shielded cable and the press-clamping portion for holding the other wire are formed by the common press-clamping portion, and therefore the connecting member can be simplified in construction, and the man-hour and the cost can be reduced.

In the shielded cable connecting structure of the invention, the problems that the operation efficiency is lowered by the operation for gathering or twisting the braided wire and that the reliability against a disturbance is low can be solved, and therefore there are obtained advantages that the connecting path of the braided wire can be positively secured and that the good operation efficiency can be achieved.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Preferred embodiments of the present invention will now be described in detail with reference to the drawings.

First Embodiment

First, a first embodiment of a shielded cable connecting structure of the invention will be described with reference to FIGS. 1 to 4.

Figure 1:
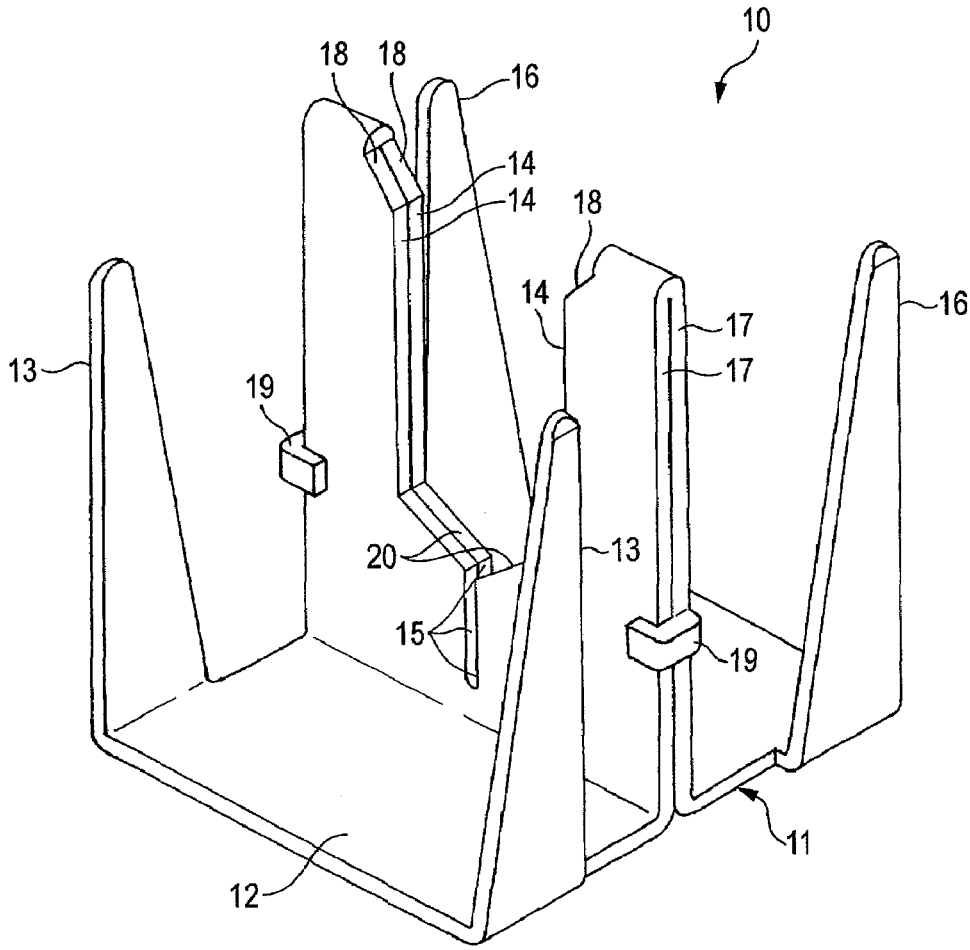
FIG. 1 is a perspective view of a connecting member used in a first embodiment of a shielded cable connecting structure of the present invention, showing its appearance.
Figure 2:
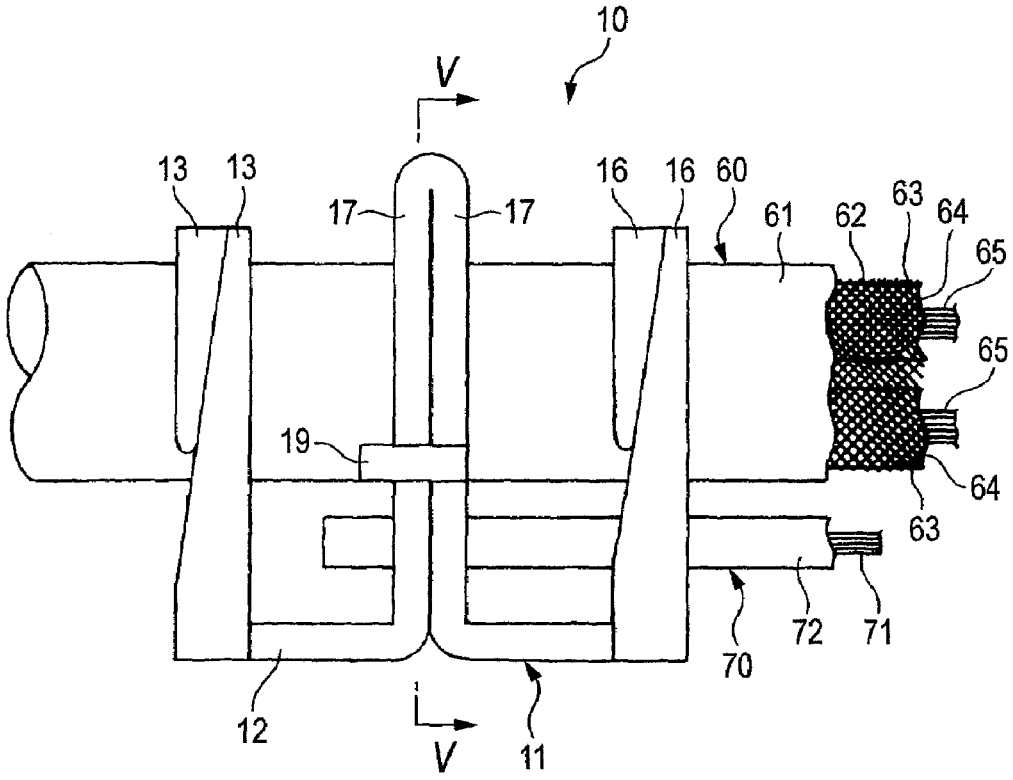
FIG. 2 is a side-elevational view of the connecting member of FIG. 1 to which a shielded cable and a grounding wire are connected.
Figure 3:
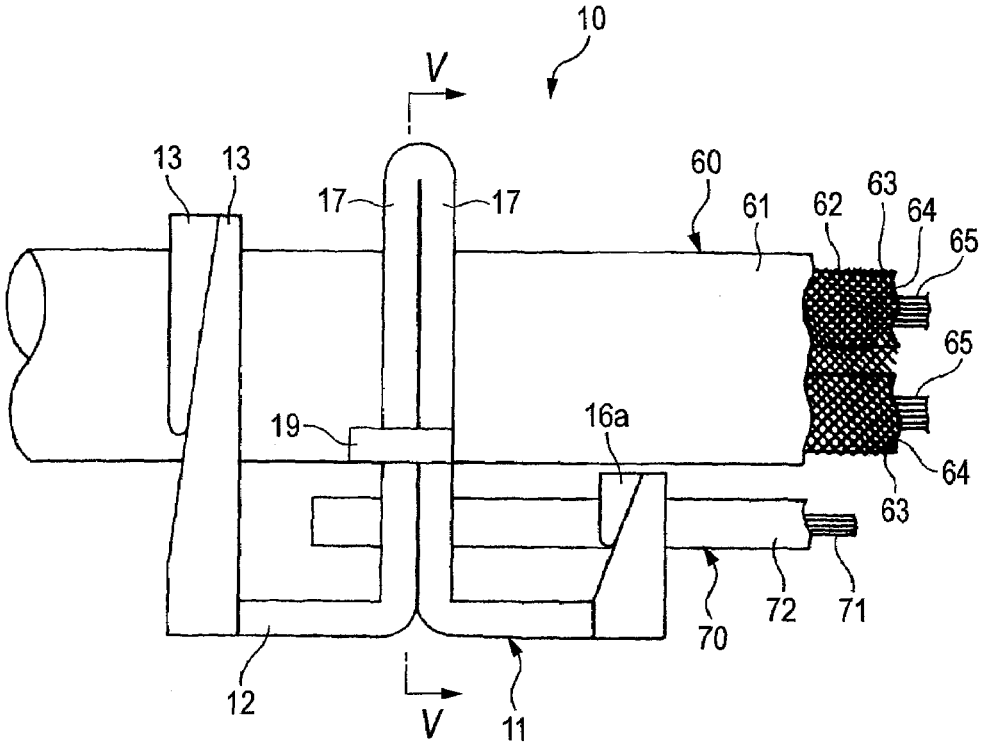
FIG. 3 is a side-elevational view of a modified example of the connecting member of FIG. 2.
Figure 4:
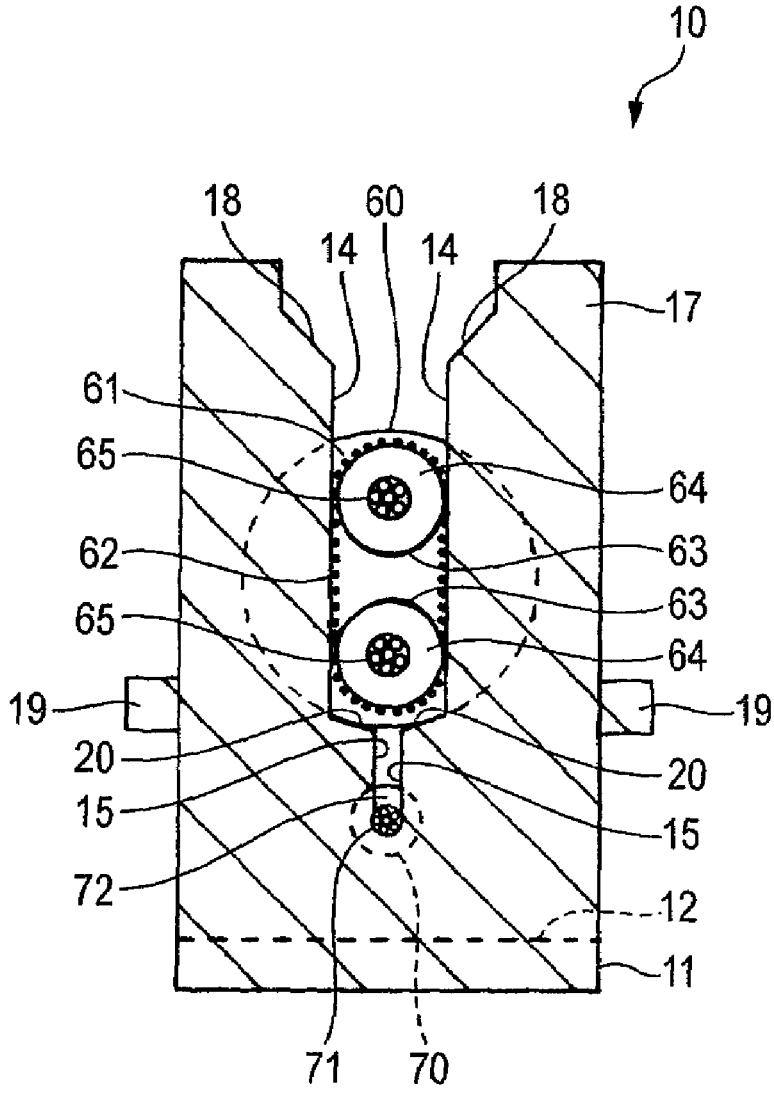
FIG. 4 is a cross-sectional view taken along the line V-V of FIG. 2.

FIG. 1 is a perspective view of a connecting member used in the first embodiment of the shielded cable connecting structure of the invention, showing its appearance, FIG. 2 is a side-elevational view of the connecting member of FIG. 1 to which a shielded cable and a grounding wire are connected, FIG. 3 is a side-elevational view of a modified connecting member, and FIG. 4 is a cross-sectional view taken along the line V-V of FIG. 2.

As shown in FIG. 1, the connecting member 10, used in the first embodiment of the shielded cable connecting structure of the invention, includes a connecting member body 11 having a bottom plate 12, a pair of first cable press-clamping portions 13 and 13 formed on and extending upwardly respectively from opposite side edges of the bottom plate 12 at one end portion of the connecting member body 11, a pair of first press-contacting portions 14 and 14 extending upwardly and disposed above the bottom plate 12 at a central portion of the connecting member body 11, a pair of second press-contacting portions 15 and 15 disposed below the pair of first press-contacting portions 14 and 14, and a pair of second cable press-clamping portions 16 and 16 formed on and extending upwardly respectively from the opposite side edges of the bottom plate 12 at the other end portion of the connecting member body 11.

The shielded cable 60 (see FIG. 2) is inserted between the pair of first cable press-clamping portions 13 and 13, and then these press-clamping portions 13 and 13 are press-fastened to the outer periphery of the shielded cable 60 in surrounding relation thereto, thereby fixing the shielded cable 60 to the connecting member 10.

A central portion of the bottom plate 12 is bent into a generally inverted U-shape to provide two upwardly-extending plate portions 17 and 17, and an upwardly-open slot or opening is formed in a central portion of each plate portion 17, and defines the first press-contacting portion 14. Each first press-contacting portion 14 is continuous with a first insertion guide portion 18 (defined by slanting surfaces also designated respectively by reference numerals 18 for convenience' sake) formed at an upper end portion of the plate portion 17. Each first press-contacting portion 14 is defined by a pair of opposed press-contacting blades which are also designated respectively by reference numerals 14 for convenience's sake, and a gap between these blades (that is, the width of the first press-contacting portion 14) is smaller than an outer diameter of an outer sheath 61 (see FIG. 2) of the shielded cable 60, and is slightly smaller than an outer diameter of a braided wire 62 (see FIG. 2) of the shielded cable 60. Therefore, when the shielded cable 60 is pressed to be inserted into the pair of first press-contacting portions 14 and 14 from the upper side, the pair of first press-contacting portions 14 and 14 cut the outer sheath 61, and are electrically connected to the braided wire 62.

Slits are formed respectively in central portions of lower portions of the two plate portions 17 and 17 disposed below the pair of first press-contacting portions 14 and 14, and each second press-contacting portion 15 is defined by opposed side edges of the corresponding slit. As is the case with the pair of first press-contacting portions 14 and 14, each second press-contacting portion 15 is defined by a pair of opposed press-contacting blades (that is, the opposed side edges of the slit) which are also designated respectively by reference numerals 15 for convenience's sake, and a gap between these blades (that is, the width of the second press-contacting portion 15) is slightly smaller than an outer diameter of a conductor 71 (see FIG. 2) of the grounding wire 70 (see FIG. 2). Therefore, when the grounding wire 70 is pressed to be inserted into the pair of second press-contacting portions 15 and 15 from the upper side before the shielded cable 60 is inserted into the pair of first press-contacting portions 14 and 14, the pair of second press-contacting portions 15 and 15 cut a sheath 72 of the grounding wire 70, and are electrically connected to the conductor 71.

A pair of hooks 19 and 19 are formed respectively at opposite side edges of one plate portion 17, and are retainingly engaged with the other plate portion 17. The two plate portions 17 and 17 are joined together in a unitary manner by these hooks 19 and 19. Each plate portion 17 has a second insertion guide portion 20 (defined by a pair of slanting surfaces also designated respectively by reference numerals 20 for convenience's sake) formed at an upper end of the second press-contacting portion 15.

The grounding wire 70 and the shielded cable 60 are inserted between the pair of second cable press-clamping portions 16 and 16, and then these press-clamping portions 16 and 16 are press-fastened to the outer sheath 61 of the shielded cable 60 and the sheath 72 of the grounding wire 70 in surrounding relation thereto, thereby fixing the shielded cable 60 and the grounding wire 70 to the connecting member 10.

For forming the connecting member 10, an electrically-conductive metal sheet having a predetermined thickness is cut into a predetermined developed shape, and then a central portion of the thus cut sheet is bent to form the pair of plate portions 17 and 17 superposed together, and also the pair of first cable press-clamping portions 13 and 13, as well as the pair of second cable press-clamping portions 16 and 16, are formed by bending relevant portions of the cut sheet opposed to each other with the bottom plate 12 disposed therebetween, thereby forming the connecting member 10. Thus, this method does not include any complicated processing step, and therefore the connecting member 10 can be formed using existing facilities.

As shown in FIG. 2, the shielded cable 60 has two wires 63 and 63 provided within the outer sheath 61, and the two wires 63 and 63 have respective conductors 65 and 65 provided respectively within respective inner sheaths 64 and 64, each of the conductors 65 and 65 being made of pure copper (CU) or tin (Sn)-plated copper. The braided wire 62 of a tubular shape braided around the outer peripheries of the inner sheaths 64 and 64 to cover them. The conductor 65 of the shielded cable 60 is used, for example, to feed a signal between a control circuit and an electrical equipment. The connecting member 10 can be used for a shielded cable 60 containing three or more wires 63 instead of the illustrated shielded cable 60 containing the two wires 63 and 63, in which case the braided wire 62 is, of course, braided around the plurality of wires 63.

The grounding wire 70 has the conductor 71 provided within the sheath 72, and is electrically connected, for example, to a metallic part such as a vehicle body panel in order to form a grounding circuit for an electrical equipment or the like including a resin-made casing. The single grounding wire 70 is used for the connecting member 10. The grounding wire 70 has a predetermined current-carrying capacity and a predetermined impedance at a region from the connecting member 10 to the vehicle body panel.

For assembling the connecting structure, first, the grounding wire 70 is pressed to be inserted into the pair of second press-contacting portions 15 and 15 from the upper side of the plate portions 17 and 17. The sheath 72 of the thus inserted grounding wire 70 is cut by the second press-contacting portions 15 and 15, and the conductor 71 is electrically connected to the second press-contacting portions 15 and 15, and hence is electrically connected to the connecting member 10. At this time, the grounding wire 70, while guided by the second insertion guide portions 20 and 20 formed respectively at the upper ends of the second press-contacting portions 15 and 15, is inserted into the second press-contacting portions 15 and 15, and therefore the smooth and positive insertion can be effected. The grounding wire 70 is led out in a right-hand direction (in FIG. 2).

Then, the shielded cable 60 is inserted into the first press-contacting portions 14 and 14 in the same direction as the direction of insertion of the grounding wire 70, that is, from the upper sides of the plate portions 17 and 17. The outer sheath 61 of the thus inserted shielded cable 60 is cut by the first press-contacting portions 14 and 14, so that the braided wire 62 is electrically connected to the first press-contacting portions 14 and 14. At this time, the shielded cable 60, while guided by the first insertion guide portions 18 and 18 formed respectively at the upper ends of the first press-contacting portions 14 and 14, is inserted into the first press-contacting portions 14 and 14, and therefore the smooth and positive insertion can be effected. The shielded cable 60 is an intermediate portion in the circuit, and therefore is led out in the left-hand and right-hand directions (in FIG. 2).

Then, the portion of the shielded cable 60 led out in the left-hand direction (in FIG. 2) is press-fastened and fixed by the first cable press-clamping portions 13 and 13, while the portion of the shielded cable 60 led out in the right-hand direction (in FIG. 2), together with the grounding wire 70, is press-fastened and fixed by the second cable press-clamping portions 16 and 16.

Incidentally, the shielded cable 60 is press-fastened by the first cable press-clamping portions 13, and therefore the connecting member 10 can be modified into such a form that second cable press-clamping portions 16 is press-fastened and fixed only to the grounding wire 70 as shown in FIG. 3.

The width of each second press-contacting portion 15 is slightly smaller than the outer diameter of the conductor 71 of the grounding wire 70 forced into the pair of second press-contacting portions 15 and 15, and therefore the conductor 71 is connected to the second press-contacting portions 15 and 15 with a large area of contact therebetween, so that the large current-carrying capacity can be secured between the conductor 71 and the plate portions 17 and 17.

And besides, the width of each first press-contacting portion 14 is slightly smaller than the outer diameter of the braided wire 62 of the shielded cable 60 forced into the pair of first press-contacting portions 14 and 14, and therefore the braided wire 62 is connected to the pair of first press-contacting portions 14 and 14 with a large area of contact therebetween, so that the large current-carrying capacity can be secured between the braided wire 62 and the plate portions 17 and 17. At this time, the outer sheath 61 of the shielded cable 60 abuts against the second insertion guide portions 20 and 20, and therefore is positively supported by the plate portions 17 and 17.

Thus, the connecting member 10 is electrically connected to the braided wire 62 with the large contact area without removing any portion of the outer sheath 61 of the shielded cable 60 and also without exposing the braided wire 62, and besides this connecting member 10 is electrically connected to the conductor 71 with the large contact area without removing any portion of the sheath 72 of the grounding wire 70 and also without exposing the conductor 71. Therefore, even when a disturbance develops around the shielded cable 60, disturbance components captured by the braided wire 62 are positively flowed to the grounding wire 70 via the first press-contacting portions 14 and 14 and the second press-contacting portions 15 and 15, thereby protecting the conductors 65 and 65 of the wires 63 and 63 from the disturbance.

Here, a contact resistance between the braided wire 62 of the shielded cable 60 (at the pair of first press-contacting portions 14 and 14) and the conductor 71 of the grounding wire 70 (at the pair of second press-contacting portions 15 and 15) is the sum of a resistance R1 between the braided wire 62 and the first press-contacting portions 14 and 14 and a resistance R2 between the conductor 71 of the grounding wire 70 and the second press-contacting portions 15 and 15. The connecting member 10 is electrically connected to the braided wire 62 with the large contact area, and also is electrically connected to the conductor 71 of the grounding wire 70 with the large contact area, and therefore the pressure of contact between the connecting member 10 and the braid 62, as well as the pressure of contact between the connecting member 10 and the conductor 71, will not be lowered, thereby suppressing the increase of the contact resistances R1 and R2 which would occur with the decrease of these contact pressures.

As described above, in the shielded cable connecting structure of the first embodiment, the grounding wire 70 is pressed to be inserted into the pair of second press-contacting portions 15 and 15, thereby electrically connecting the conductor 71 of this grounding wire 70 to the second press-contacting portions 15 and 15. Also, the shielded cable 60 is pressed to be inserted into the pair of first press-contacting portions 14 and 14 in the same direction as the direction of insertion of the grounding wire 70, thereby electrically connecting the braided wire 62 of this shielded cable 60 to the first press-contacting portions 14 and 14. As a result, the braided wire 60, while kept braided around the wires 63 and 63, is connected to the grounding wire 70 via the first press-contacting portions 14 and 14 and the second press-contacting portions 15 and 15 without being gathered or twisted, and therefore the braided wire 62 is grounded while maintaining the sufficient capacity.

And besides, the connection is made in such a manner that the signal feeding wires 63 and 63 are not exposed, but are kept covered with the braided wire 62, and therefore these wires 63 and 63 will not be subjected to a disturbance. Furthermore, the grounding wire 70 and the shielded cable 60 can be connected to the connecting member 10 merely by inserting them into the connecting member 10 in the same direction, and therefore the efficiency of the operation can be markedly enhanced. Therefore, the connecting path of the braided wire 62 can be positively secured, and also the good operation efficiency can be achieved.

Furthermore, in the shielded cable connecting structure of the first embodiment, the shielded cable 60 is guided to the first press-contacting portions 14 and 14 through the first insertion guide portions 18 and 18, while the grounding wire 70 is guided to the second press-contacting portions 15 and 15 through the second insertion guide portions 20 and 20. Therefore, the smooth and positive insertion can be effected, and this prevents the incomplete insertion, thus eliminating an error in the operation.

Next, a second embodiment of a shielded cable connecting structure of the invention will be described with reference to FIGS. 5 to 7. Those constituent elements of this second embodiment identical or similar in function to those of the above shielded cable connecting structure of the first embodiment will be designated by identical or like reference numerals, respectively, and explanation thereof will be simplified or omitted.

Figure 5:
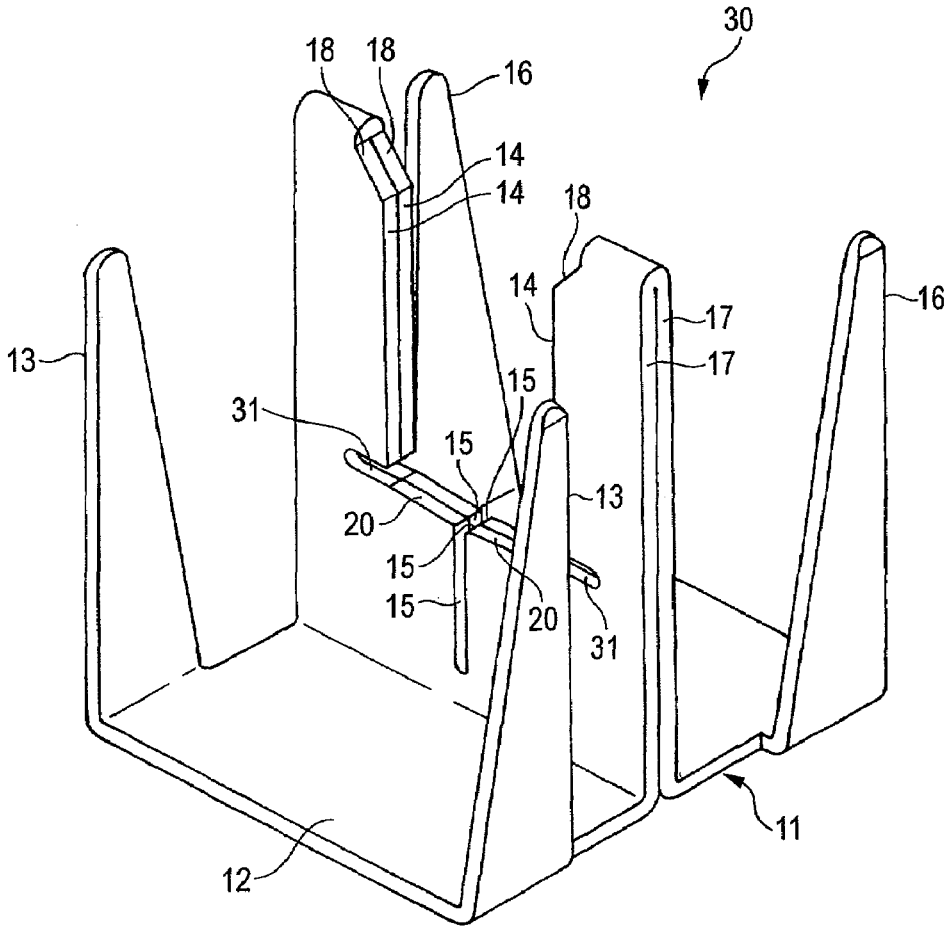
FIG. 5 is a perspective view of a connecting member used in a second embodiment of a shielded cable connecting structure of the invention, showing its appearance.
Figure 6:
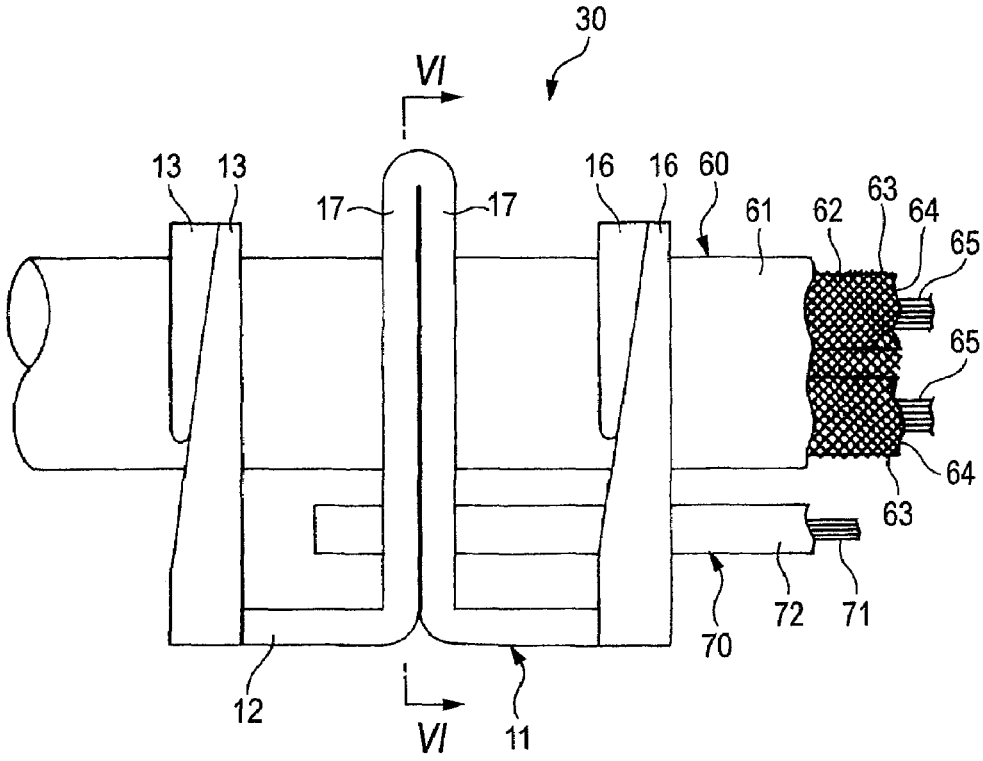
FIG. 6 is a side-elevational view of the connecting member of FIG. 5 to which a shielded cable and a grounding wire are connected.
Figure 7:
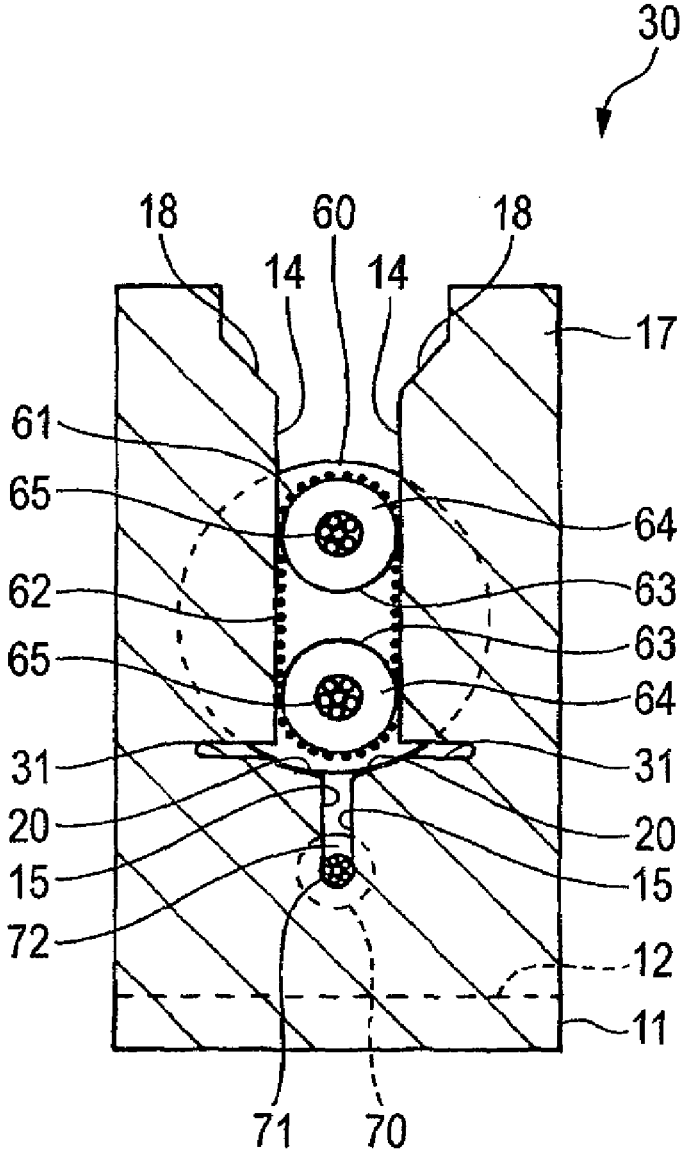
FIG. 7 is a cross-sectional view taken along the line VI-VI of FIG. 6.
Figure 8:
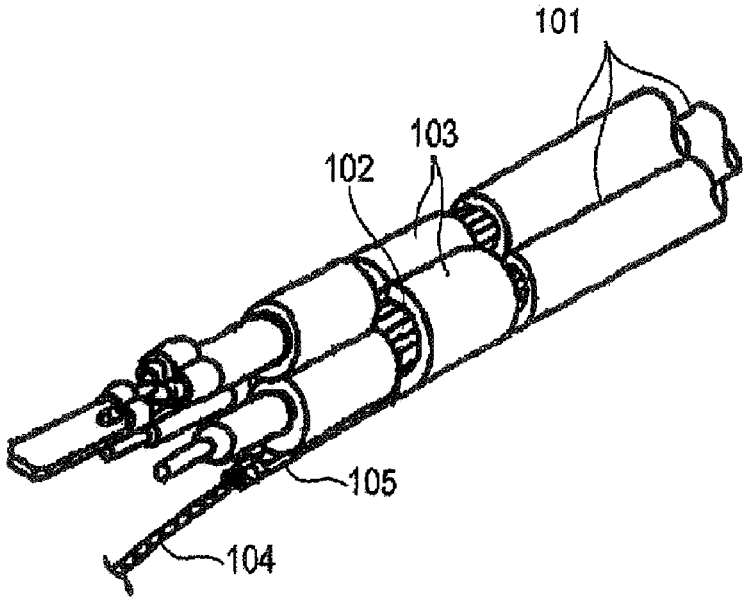
FIG. 8 is a view showing a related shielded cable connecting structure, showing its appearance.

FIG. 5 is a perspective view of a connecting member used in the second embodiment of the shielded cable connecting structure of the invention, showing its appearance, FIG. 6 is a side-elevational view of the connecting member of FIG. 5 to which a shielded cable and a grounding wire are connected, and FIG. 7 is a cross-sectional view taken along the line VI-VI of FIG. 6.

As shown in FIG. 5, the connecting member 30, used in the second embodiment of the shielded cable connecting structure of the invention, has a pair of laterally-extending notches 31 and 31 formed in plate portions 17 and 17 and disposed at the lower side of first press-contacting portions 14 and 14 and at the upper side of second press-contacting portions 15 and 15. The other portions of the connecting member 30 are the same as those of the connecting member 10 of the first embodiment.

The notches 31 and 31 are formed to be disposed between the first press-contacting portions 14 and 14 and the second press-contacting portions 15 and 15, and therefore the first press-contacting portions 14 and the second press-contacting portions 15 and 15 are separated from each other by the notches 31 and 31. Therefore, during the time when the shielded cable 60 is pressed to inserted into the first press-contacting portions 14 and 14 after the conductor 71 of the grounding wire 70 is electrically connected to the second press-contacting portions 15 and 15, large stresses produced when pressing the shielded cable 60 will not be transmitted to the second press-contacting portions 15 and 15 even if the shielded cable 60 as well as the wires 63 has a large diameter. Therefore, the conductor 71 of the grounding wire 70 already press-contacted with the second press-contacting portions 15 and 15 will not be displaced relative to these second press-contacting portions 15 and 15, and also the second press-contacting portions 15 and 15 will not be tilted, thereby securing the electrical connection while maintaining the predetermined contact pressure.

In the shielded cable connecting structure of the second embodiment, during the time when the shielded cable 60 is press-contacted with the first press-contacting portions 14 and 14 after the grounding wire 70 is press-contacted with the second press-contacting portions 15 and 15, the inserting stresses of the shielded cable 60 will not be transmitted to the second press-contacting portions 15 and 15 thanks to the provision of the notches 31 and 31. Therefore, the second press-contacting portions 15 and 15 and the conductor 71 of the grounding wire 70, as well as the first press-contacting portions 14 and 14 and the braided wire 62 of the shielded cable 60, can be kept in the positively connected condition without inviting a relative displacement therebetween, etc. This ensures the quality.

The invention is not limited to the above embodiments, and suitable modifications, improvement and so on can be made. For example, the shape of the first press-contacting portion, as well as the shape of the second press-contacting portion, is given merely as one example, and is not limited to any specified shape, and such first and second press-contacting portions can be arranged parallel at the connecting member body, in which case cable(s) and the wire are arranged in a plurality of rows for grounding purposes.

Furthermore, the angle of inclination of the first insertion guide portions and the angle of inclination of the second insertion guide portions can be suitably determined according to the outer diameters of the shielded cable and the grounding wire which are to be used with the connecting member of the invention.

Furthermore, instead of the pair of notches shown in the drawings, a plurality of pairs of notches can be provided, in which case the width of each slit- or slot-like notch can be suitably determined according to stresses to be applied to the shielded cable.

Furthermore, instead of the grounding wire (which is the other wire), a signal return wire can be used.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

The present application is based on Japan Patent Application No. 2006-024734 filed on Feb. 1, 2006, the contents of which are incorporated herein for reference.

What is claimed is:

1. A shielded cable connecting structure for connecting a shielded cable to an electric wire having a conductor, the shielded cable including an electric wire portion which has a conductor and an inner sheath covering the conductor, a braided wire braided around the inner sheath, and an outer sheath covering the braided wire, the shielded cable connecting structure comprising:

a connecting member that includes:

a connecting main body;

a first press-clamping portion which holds the shielded cable;

a second press-clamping portion which holds the electric wire;

a first press-contacting portion which defines a first slit for electrically connecting said first press-contacting portion to the braided wire of the shielded cable in a state that the shielded cable is pressed to be inserted into the first slit; and a second press-contacting portion which defines a second slit for electrically connecting said second press-contacting portion to the conductor of the electric wire in a state that the electric wire is pressed to be inserted into the second slit in the same direction as a direction of insertion of the shielded cable into the first slit, wherein the braided wire of the shielded cable is connected to the electric wire through the first press-contacting portion and the second press-contacting portion, and wherein the first slit and the second slit are defined in a single plane and the second slit is located below the first slit.

2. The shielded cable connecting structure according to claim 1, wherein the connecting member includes an insertion guide portion having a generally slanting shape provided at at least one of the first press-contacting portion and the second press-contacting portion.

3. The shielded cable connecting structure according to claim 1, wherein the connecting member has a notch for preventing mutual deformation of the first and second press-contacting portions, the notch being provided between the first press-contacting portion and the second press-contacting portion.

4. The shielded cable connecting structure according to claim 3, wherein the connecting member includes an insertion guide portion having a generally slanting shape provided at at least one of the first press-contacting portion and the second press-contacting portion.

5. The shielded cable connecting structure according to claim 3, wherein the first press-clamping portion and the second press-clamping portion are formed by a single press-clamping portion.

6. The shielded cable connecting structure according to claim 1, wherein the first press-clamping portion and the second press-clamping portion are formed by a single press-clamping portion.

7. The shielded cable connecting structure according to claim 1, wherein at least one of the first press-contacting portion and the second press-contacting portion is electrically connected to at least one of the electric wire and the shielded cable at an intermediate portion of the at least one electric wire and shielded cable.

8. The shielded cable connecting structure according to claim 1, wherein the first press-clamping portion and the second press-clamping portion lie in a plane perpendicular to the electric wire and shielded cable.

9. The shielded cable connecting structure according to claim 1, wherein, when the shielded cable and electric wire are connected, the shielded cable is parallel to the electric wire.

10. The shielded cable connecting structure according to claim 1, wherein a width of the second press-clamping portion is smaller than the width of the first press-clamping portion.

11. The shielded cable connecting structure according to claim 1, wherein the conductor of the shielded cable and the conductor of the electric wire are unexposed when the shielded cable is pressed to be inserted into the first press-contacting portion and the electric wire is pressed to be inserted into the second press-contacting portion.

12. The shielded cable connecting structure according to claim 1, wherein the first slit and the second slit are continuous.

* * * * *